US006829865B2

(12) United States Patent
Smith

(10) Patent No.: US 6,829,865 B2
(45) Date of Patent: Dec. 14, 2004

(54) JAMB EXTENDER FOR WALL FINISHING SYSTEM

(75) Inventor: Mark H. Smith, Newark, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 10/402,010

(22) Filed: Mar. 28, 2003

(65) Prior Publication Data

US 2004/0187408 A1 Sep. 30, 2004

(51) Int. Cl.[7] ..... E06B 1/04

(52) U.S. Cl. ..... 52/211; 52/204.53; 52/506.05; 52/717.01; 52/745.15

(58) Field of Search ..... 52/204.1, 208, 52/745.15, 211, 212, 213, 217, 204.56, 717.01, 764

(56) References Cited

U.S. PATENT DOCUMENTS

| | | | | | |
|---|---|---|---|---|---|
| D252,471 | S | * | 7/1979 | Broadbent | D25/119 |
| 4,164,107 | A | * | 8/1979 | Kraemling et al. | 52/232 |
| 4,179,849 | A | * | 12/1979 | Kuffner | 49/505 |
| 4,856,239 | A | * | 8/1989 | Elsasser | 52/98 |
| 5,115,605 | A | | 5/1992 | Butler | |
| 5,678,383 | A | * | 10/1997 | Danielewicz | 52/775 |
| 5,791,104 | A | | 8/1998 | Baier et al. | |
| 5,822,931 | A | | 10/1998 | Galowitz et al. | |
| 5,893,243 | A | | 4/1999 | Ortner | |
| 6,050,036 | A | * | 4/2000 | Frey | 52/204.5 |
| 6,125,605 | A | | 10/2000 | Young | |
| 6,141,922 | A | | 11/2000 | Carlisle et al. | |
| 6,148,582 | A | | 11/2000 | Ellingson | |
| D454,962 | S | * | 1/2002 | Grace | D25/119 |
| 6,347,492 | B1 | | 2/2002 | Richardson | |
| 6,360,500 | B1 | | 3/2002 | Wilcox | |
| 6,378,266 | B1 | | 4/2002 | Ellingson | |
| 6,588,165 | B1 | * | 7/2003 | Wright | 52/506.05 |
| D481,804 | S | * | 11/2003 | Pefrey | D25/119 |
| D488,570 | S | * | 4/2004 | Houssian | D25/136 |
| 2002/0056241 | A1 | | 5/2002 | Wilcox | |
| 2003/0226321 | A1 | * | 12/2003 | Engebretson | 52/204.54 |

* cited by examiner

*Primary Examiner*—Robert Canfield
(74) *Attorney, Agent, or Firm*—Inger H. Eckert; Maria C. Gasaway

(57) ABSTRACT

A jamb extender for extending extend the jamb of the window is provided. The jamb extender includes a base member, two arm members projecting orthogonally from same side of the base member, and projecting members extending perpendicularly from the end of the arms towards an opposing end of the base member. The jamb extender has a unibody construction and is preferably formed of vinyl or polyvinylchloride. The jamb extender can be used in a jamb extension assembly that includes a lineal trim holder and a trim member. The jamb extender is positioned such that a portion of the base member is adjacent to the base wall and the projecting members are adjacent to the mounting portion of the lineal trim holder to extend the jamb of the window. A decorative trim member is mounted in the trim mounting portion. A method of trimming a window opening is also provided.

15 Claims, 2 Drawing Sheets

JAMB EXTENDER FOR WALL FINISHING SYSTEM

BACKGROUND OF THE INVENTION

When constructing the doors and windows of a building, a rough opening is usually formed with framing timbers, which in residential housing, are typically two by four studs. A prefabricated frame is then installed in the rough opening. In the case of a window, this frame generally includes a window sill assembly, a pair of spaced vertical jambs defining the sides of the frame, and a jamb at the top of the frame. The jambs are formed to receive a prefabricated widow casing.

For many years, window jambs have been formed of wood. Since the surfaces of these jambs are generally visible, it has historically been necessary to fabricate door jambs from high grade clear lumber that has no knots, is stable when subjected to moisture (e.g., does not rot, decay or warp) and can be stained and/or painted to match or create a suitable décor. Although such lumber was plentiful from old growth forests for decades, it is becoming rare to find such lumber and is becoming correspondingly expensive. Accordingly, there exists a need for a window jamb assembly that uses no wood, that is virtually resistant to mold, rot, decay, and warpage, and that is not subject to degradation due to thermal expansion and contraction.

SUMMARY OF THE INVENTION

An embodiment of the present invention provides a jamb extender that includes a base member and two arm members projecting orthogonally from the same side of the base member to form an "F" shaped configuration. Projecting members extend perpendicularly from the end of the arms and are projected towards the opposing end of the base member. Preferably, the jamb extender is formed of a rigid plastic material such as vinyl or polyvinylchloride (PVC). The jamb extender can be used to trim out windows, doors, and other openings. In particular, the jamb extender can be used to cover the framing of a window positioned in a base wall and extend the jamb of the window, such as to permit the construction of an interior wall which is to be attached to the base wall, e.g., in basement wall finishing systems.

An embodiment of the present invention provides a jamb extension assembly that includes a jamb extender, a lineal trim holder, and a trim component. The jamb extender includes a base member and two arm members projecting orthogonally from the same side of the base member to form an "F" shaped configuration. Projecting members extend perpendicularly from the end of the arms and are projected towards the opposing end of the base member. Preferably, the jamb extender is formed of vinyl or polyvinylchloride (PVC). The lineal trim holder includes a base member for affixing the trim holder to a base wall and a trim mounting portion that extends orthogonally from the base member. The trim mounting portion includes a pair of holding members which hold the trim component. In addition, the lineal trim holder has an offset recess which is defined by the base member and the trim mounting portion. In the jamb extension assembly, the arms and projecting members of the jamb extender are positioned in the offset recess. The jamb extension assembly can be used to extend the jamb of a window, such as to permit the construction of an interior wall, e.g., in basement wall finishing systems.

An embodiment of the present invention provides a method of trimming a window opening in a base wall. A lineal trim holder having an offset recess defined by a base member and a trim mounting portion is attached to the base wall adjacent to the window opening such that the trim mounting portion extends outwardly from the base wall. Next, a jamb extender is connected to the lineal trim holder. The jamb extender includes a base member, two arm members projecting orthogonally from same side of the base member to form an "F" shaped configuration, and projecting members that extend perpendicularly from the end of the arms toward the opposing end of the base member. The arms and projecting members of the jamb extender are positioned in the offset recess adjacent to the trim mounting portion such that the base member is located adjacent to the base wall. A trim mounting member is then mounted to the trim holder portion of the lineal trim holder to complete the window trimming.

Example embodiments of the present invention will appear more fully hereinafter from a consideration of the detailed description that follows, in conjunction with the accompanying sheets of drawings. It is to be expressly understood, however, that the drawings are for illustrative purposes and are not to be construed as defining the limits of the invention.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION AND EXAMPLE EMBODIMENTS OF THE INVENTION

Hereinafter, example embodiments of the present invention will be described in detail with reference to the attached drawings, in which example embodiments of the invention are shown. The invention may, however, be embodied in many different forms and should not be construed as being limited to the example embodiments set forth herein. Rather, these example embodiments are provided so that this disclosure will be thorough and complete and will fully convey the concept of the present invention to those skilled in the art. Throughout the specification, like numbers refer to like elements. It is to be understood that when an element is referred to as being "perpendicular" to another element, it can be perpendicular to the element or substantially perpendicular to the element. It is also to be understood that the attached drawings are not drawn to scale.

Figure 1:
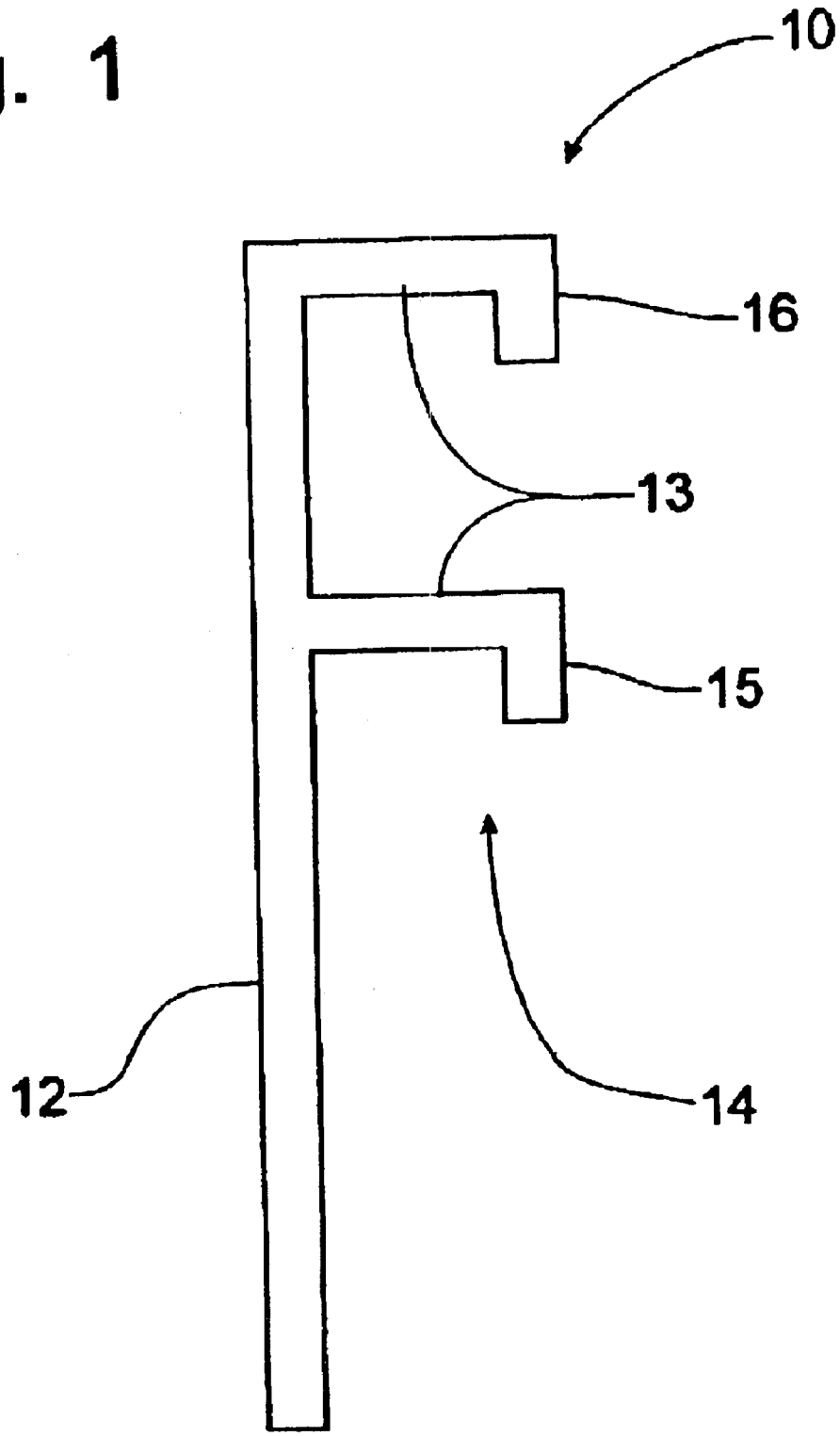
FIG. 1 is an end view of a jamb extender according to an example embodiment of the present invention.

Referring to FIG. 1, a jamb extender according to an embodiment of the present invention can be seen. As shown in FIG. 1, the jamb extender 10 includes a base member 12 and two arm members 13 projecting orthogonally from the same side of the base member 12. Projecting members 15, 16 extend perpendicularly from the end of the arms 13 and are projected towards the opposing end of the base member 12. In particular, the arm members 13 project outwardly from the base member 12 to form an "F" shaped configuration. The jamb extender 10 can be used to trim out windows, doors, and other openings. For example, the jamb extender 10 can be used to cover the framing of a window positioned in a base wall and extend the jamb of the window, such as to permit the construction of an interior wall which is to be attached to the base wall, e.g., in basement wall finishing systems.

The jamb extender 10 has a unibody construction. As a result, there are no separate layers of materials that have differing coefficients of thermal expansion. In addition, the unibody construction of the jamb extender 10 permits ease of manufacturing, preferably by thermoplastic extrusion techniques that are well known in the art. Preferably the jamb extender 10 is formed of rigid plastic materials, such as, but not limited to, vinyl, polyvinylchloride (PVC), and the like. Other examples of materials suitable for the jamb extender 10 would be easily determined by one of skill in the art. The jamb extender 10 constructed in this manner is durable and inexpensive. In addition, the jamb extender 10 can be manufactured in various colors, which provides purchasers of these jamb extenders with a selection for matching colors in the interior of the building. As a particular example in terms of size, the arms 13 can measure approximately 1½ inches, the projecting members 15, 16 can measure approximately ⅝ inches, and the length of the base member 12 can measure approximately 6 inches.

Figure 2:
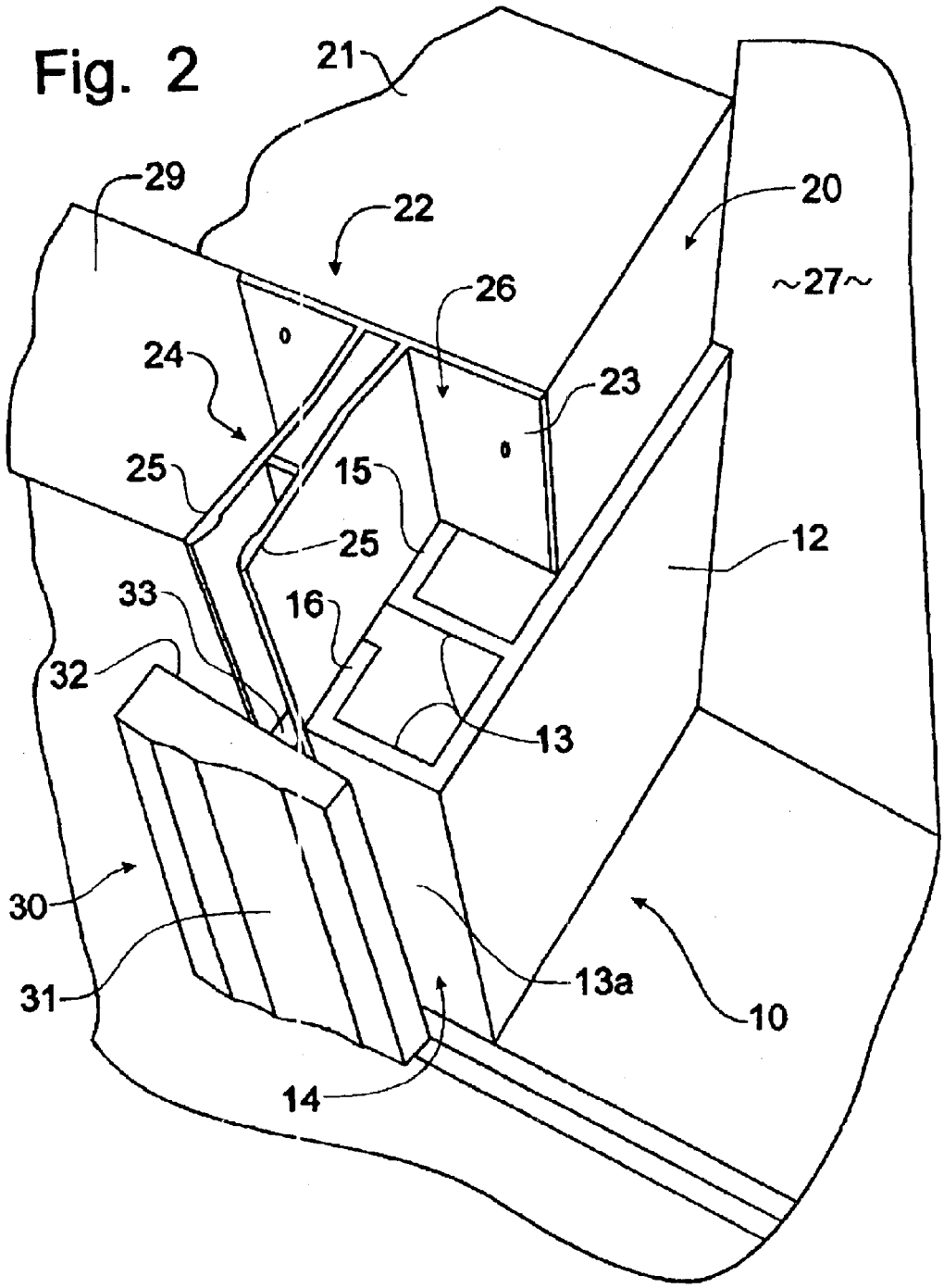
FIG. 2 is a perspective view of a jamb extension assembly according to an example embodiment of the present invention.

Referring now to FIG. 2, a jamb extension assembly 20 according to an embodiment of the present invention can be seen. A lineal trim holder 22 is formed of a support member 23 and a trim mounting portion 24 that extends orthogonally from the support member 23. The trim mounting portion 24 includes a pair of holding members 25 which hold a trim member 30. For example, the lineal trim holder 22 can be formed in a T-shaped configuration with the support member 23 projecting laterally on opposite sides of the trim mounting portion 24. In the jamb extension assembly 20, the lineal trim holder 22 may be attached to a base wall 21 by a fastening device (not shown) such as a screw or nail (e.g., a masonry nail).

The jamb extender 10 is affixed to the lineal trim holder 22 via the projecting member 15. For example, the projecting member 15 may be affixed to the trim mounting portion 24 by a conventional fastening device, such as a screw or nail, or through the use of adhesives. The base member 12 may be affixed to the base wall 21 by fasteners or by adhesives, or both. As shown in FIG. 2, the base member 12 of the jamb extender 10 extends perpendicularly to a window 27, e.g., a window pane, to cover a side edge of the base wall 21. Thus, the jamb extender 10 may cover defects or other displeasing qualities in the side edge of the base wall 21 and cosmetically enhance the side edge of the base wall 21.

The arms 13 and projecting members 15, 16 of the jamb extender 10 are positioned in an offset recess 26 defined by the support member 23 and the trim mounting portion 24 of the lineal trim holder 22. In particular, the jamb extender 10 is positioned such that a portion of the base member 12 is adjacent to the base wall 21 and the projecting members 15,16 are adjacent to the mounting portion 24 of the lineal trim holder 22, such that the jamb extender 10 extends a jamb of the window, e.g., extends the portion of the base wall 21 extending from the window 27 to a face 29 of the base wall 21, in a direction away from the base wall 21. For example, the jamb extender 10 may extend the jamb of the window a distance substantially equal to the distance from the face 29 of the base wall 21 to an end 13*a* of the jamb extender 10. Thus, when the jamb extender 10 is used, the jamb of the window has a length that is substantially equal to the length of the base member 12. The arms 13 and projecting members 15, 16 may be dimensioned to fill the offset recess 26 and abut the trim mounting portion 24.

A trim member 30 having a front side 31, a back side 32, and a mounting projection member 33 is affixed to the lineal trim holder 22. The mounting projection member 33 is positioned between the holding members 25 of the trim mounting portion 24 to hold the trim member 30 against the end 13*a* of the jamb extender 10 and an interior wall portion (not shown). The mounting projection member 33 of the trim member 30 may be formed such that it fits snugly between the holding members 25 without the use of conventional fasteners. In addition, the mounting projection member 33 may or may not be flush with the holding members 25. The front side 31 of the trim member 30 can be molded and/or colored so as to provide a finished, decorative look to the window trimming.

To trim a window and extend the jamb of the window using the jamb extender assembly 20 described above, the lineal trim holder 22 is affixed to the base wall 21 with the trim mounting portion 24 extending perpendicularly from the base wall 21. The jamb extender 10 is then affixed to the lineal trim holder 22 such that the arms 13 and projecting members 15, 16 of the jamb extender 10 are positioned in the offset recess 26 defined by the support member 23 and the trim mounting portion 24 of the lineal trim member 22 and the base member 12 is adjacent to the base wall 21. Both the lineal trim holder 22 and the jamb extender 10 can be affixed by conventional fasteners such as screws or nails, e.g., masonry nails, or by adhesives. The trim member 30 is then mounted between the holding members 25 of the lineal trim holder 22 to bridge between the arms 13 and an interior wall (not shown). Since the mounting projection member 33 is positioned between the holding members 25, the projecting member 16 should not be affixed to the trim holder 22 by fasteners.

Having thus described the invention, what is claimed is:

1. A jamb extender for trimming an interior surface adjacent a window set in a base wall with a vertically extending jamb member protection interiorly from said window, comprising;

a linearly extending base member extending perpendicularly to said window and parallel to said jamb member, said base member covering said jamb member and terminating at an end positioned interiorly from said jamb member;

arm members projecting orthogonally from the same side of the base member; and projecting members, each projecting member extending perpendicularly from an end of each respective said arm member toward an opposing end of the base member.

2. The jamb extender of claim 1, wherein the jamb extender is formed of a member selected from the group consisting of vinyl and polyvinyl chloride.

3. The jamb extender of claim 2, wherein the jamb extender has a unibody construction.

4. The jamb extender of claim 1, wherein the arms members are approximately 1½ inches in length, the projecting members are approximately ⅝ inches in length, and the base member is approximately 6 inches in length.

5. The jamb extender of claim 1, wherein the jamb extender is formed in an F-shaped configuration.

6. A jamb assembly for trimming interior portions of a building wall surrounding a window opening where the building wall is formed of a base wall portion, comprising:

a lineal trim holder attached to the base wall portion adjacent the window opening, the trim holder including an L-shaped configuration having an offset recess defined by a support member attached to the base wall portion and a trim mounting portion extending orthogonally from the support member;

a jamb extender having a linearly extending base member extending perpendicularly to the window to cover a side edge of the base wall portion, arm members projecting orthogonally from the same side of the base member, and projecting members extending perpendicularly from each respective arm member toward an opposing end of the base member, said arm members and said projecting members being positioned adjacent said trim holder along said interior portion; and a trim member affixed to the trim mounting portion to bridge between the jamb extender and an interior wall portion adjacent the trim mounting portion.

7. The jamb assembly of claim 6, wherein the lineal trim holder is formed in a T-shaped configuration with the support member projecting laterally on opposing sides of the trim mounting portion.

8. The jamb assembly of claim 6, wherein the trim mounting portion includes a pair of holding members.

9. The jamb assembly of claim 8, wherein the trim member is formed with a mounting projection that engages the trim mounting portion to hold the trim member in position between the holding members.

10. The jamb assembly of claim 9, wherein the arm members and the projecting members are positioned in the offset recess.

11. The jamb assembly of claim 10, wherein the jamb extender is positioned such that a portion of the support member is adjacent to the base wall to extend a jamb portion of the window.

12. A method of trimming an interior portion of a window opening in a base wall comprising:

attaching a lineal trim holder to the base wall adjacent the window opening, the lineal trim holder having an offset recess defined by a support member attached to the base wall and a trim mounting portion extending orthogonally along said interior portion from the support member;

connecting a jamb exender to the lineal trim holder, the jamb extender having a linearly extending base member, arm members projecting orthogonally from the same side of the base member, and projecting members extending perpendicularly from each respective arm member toward an opposing end of the base member, said connecting step positioning said projecting members adjacent to said lineal trim holder; and mounting a trim piece to the trim mounting portion of the lineal trim holder.

13. The method of claim 12, wherein the connecting step orients the jamb extender to form a continuous jamb portion extending from a window to an end of the trim mounting portion.

14. The method of claim 12, wherein the connecting step includes:

positioning a portion of the base member adjacent to the base wall and the projecting members adjacent to die trim mounting portion; and inserting fasteners through the trim mounting portion and at least one arm member.

15. The method of claim 12, wherein the connecting step positions said arm members and said projecting members within said offset recess.

* * * * *

UNITED STATES PATENT AND TRADEMARK OFFICE

CERTIFICATE OF CORRECTION

PATENT NO. : 6,829,865 B2
DATED : December 14, 2004
INVENTOR(S) : Smith

It is certified that error appears in the above-identified patent and that said Letters Patent is hereby corrected as shown below:

Column 4,
Line 35, “protection interiorly” should read -- projecting interiorly --

Column 6,
Line 25, “adjacent to die” should read -- adjacent to the --

Signed and Sealed this

Twenty-second Day of February, 2005

JON W. DUDAS
*Director of the United States Patent and Trademark Office*